US006817323B2

(12) United States Patent
Notaras et al.

(10) Patent No.: US 6,817,323 B2
(45) Date of Patent: Nov. 16, 2004

(54) INTERNAL COMBUSTION ENGINE

(76) Inventors: John Arthur Notaras, 18 Hunter Street, Dover Heights, NSW 2030 (AU); Angelo Lambrinos Notaras, 86 Victoria Road, Bellevue Hill, NSW 2023 (AU)

( * ) Notice: Subject to any disclaimer, the term of this patent is extended or adjusted under 35 U.S.C. 154(b) by 0 days.

(21) Appl. No.: 10/466,775

(22) PCT Filed: Feb. 1, 2002

(86) PCT No.: PCT/AU02/00103

§ 371 (c)(1),
(2), (4) Date: Nov. 20, 2003

(87) PCT Pub. No.: WO02/061245

PCT Pub. Date: Aug. 8, 2002

(65) Prior Publication Data

US 2004/0079304 A1 Apr. 29, 2004

(51) Int. Cl.[7] ..... F02B 33/04
(52) U.S. Cl. ..... 123/73 A; 123/73 F
(58) Field of Search ..... 123/73 F, 73 PP, 123/73 A, 73 AA, 73 AC, 73 AF, 193.6, 58.5, 74 AE

(56) References Cited

U.S. PATENT DOCUMENTS

| | | | | | |
|---|---|---|---|---|---|
| RE16,069 | E | * | 5/1925 | Macfarren | 123/41.72 |
| 3,707,143 | A | * | 12/1972 | Reese et al. | 123/65 A |
| 4,026,254 | A | | 5/1977 | Ehrlich | |
| 4,051,820 | A | | 10/1977 | Boyesen | |
| 4,067,302 | A | | 1/1978 | Ehrlich | |
| 4,075,985 | A | * | 2/1978 | Iwai | 123/73 A |
| 4,253,433 | A | * | 3/1981 | Blair | 123/73 R |
| 4,481,911 | A | | 11/1984 | Sheaffer et al. | |
| 4,708,100 | A | | 11/1987 | Luo | |
| 4,893,596 | A | * | 1/1990 | Nonaka | 123/193.6 |
| 4,948,279 | A | | 8/1990 | Ikoma et al. | |
| 6,085,703 | A | | 7/2000 | Noguchi | |
| 2001/0020454 | A1 | | 9/2001 | Kobayashi | |

FOREIGN PATENT DOCUMENTS

| | | |
|---|---|---|
| EP | 0115758 | 8/1984 |
| JP | 11082081 A | 8/1997 |
| WO | WO 98/34016 | 8/1998 |
| WO | WO 00/43660 | 7/2000 |

* cited by examiner

*Primary Examiner*—Andrew M. Dolinar
*Assistant Examiner*—Katrina B. Harris
(74) *Attorney, Agent, or Firm*—Arent Fox PLLC

(57) ABSTRACT

The present invention discloses a crankcase scavenging internal combustion engine (1) having a transfer passage (8) interconnecting the crankcase (3) and the cylinder (2) via a conventional transfer port (20). An air supply tube (16) is connected to the transfer passage (8) via a reed valve (17). The transfer passage has a volume which is an appreciable percentage of the swept volume of the cylinder. When the crankcase is depressurized, air enters via the reed valve (17) and scavenges the transfer passage (8). When the crankcase is pressurized and the transfer port opens, the air remaining in the transfer passage which is substantially free of fuel is used to scavenge the cylinder. Some of this air enters the exhaust port (7) and some remains in the cylinder to form part of the combustion gases. The fuel free air remaining in the cylinder enables the quantity of oil in the gasoline/oil fuel mixture to be reduced. Provision of a decompression valve (30), preferably adjacent the exhaust port (7) enables a fuel mixture enriching effect, equivalent to choking, to be achieved at starting.

32 Claims, 5 Drawing Sheets

INTERNAL COMBUSTION ENGINE

CROSS-REFERENCE TO RELATED APPLICATION

This application is a National Stage entry of International Application No. PCT/AU02/00103.

FIELD OF THE INVENTION

The present invention relates to internal combustion engines and, in particular, to crankcase scavenging two stroke internal combustion engines.

Whilst the invention will be described in relation to gasoline engines operating on a liquid fuel comprising a mixture of gasoline and oil, the invention is equally applicable to diesel engines operating on diesel fuel (liquid) or engines which operate on natural gas or other gaseous fuels.

The term "fluid", as used herein is intended to embrace both liquids and gases and atomized liquids.

The term "gaseous fuel mixture" refers to liquid fuel that has been atomised and mixed with air into a gaseous state, or to a mixture of gaseous fuel (eg natural gas) and air.

The term "fuel free air" refers to air which has been introduced into the engine without atomising of liquid fuel. The air is therefore substantially fuel free when residual in the transfer passage and when transferred into the cylinder.

The term "combustion chamber" is the zone within the cylinder where the initial combustion of the combustion gases occurs.

The term "cylinder" includes the combustion chamber within the cylinder.

The term "swept volume of the cylinder" is the volume which is calculated by the piston travel distance, from top dead centre to bottom dead centre, multiplied by the effective internal diameter of the cylinder.

BACKGROUND ART

Two stroke engines have been known for many years and have many advantages including their simplicity and ability to be made in small sizes and light weights. In particular two stroke engines find application in many appliances such as outboard motors, mopeds, motor scooters, brush cutters, chain saws, lawn mowers and the like and numbers in use worldwide are in the many tens of millions. A particular disadvantage of prior art two stroke engines is that the scavenging of the cylinder so as to remove the combustion products is accomplished by means of the incoming gaseous fuel mixture. Thus, some of the incoming gaseous fuel mixture passes directly through the cylinder and into the exhaust without having been burnt in the cylinder. As a consequence, there is an inherent loss of efficiency in that a proportion of the fuel consumed is wasted. There is also an undesirable contribution to pollution in that unburnt fuel is allowed to escape into the exhaust system.

In the past there have been various attempts to overcome this higher fuel consumption and in recent times also the high exhaust emission problems. However these various attempts have been operationally complicated, expensive to manufacture, and generally not commercially successful.

Another disadvantage of the conventional two-stroke engine is the relatively high amount of oil that is required to be mixed with the gasoline in order for the engine to be lubricated. This leads to not only higher exhaust emission problems but also higher economic cost in terms of oil consumed.

The following prior art specifications disclosed by novelty searches conducted after the due date, are representation of the prior art.

Japanese Patent 11-82081 (Hirano) discloses an engine of complicated construction. One version has 3 rotary valve mechanisms to control exhaust, air and gaseous fuel mixture respectively. The other versions have a single rotary valve mechanism. These rotary valve mechanisms complicate the construction and cost of such an engine.

U.S. Pat. No. 4,026,254 Ehrlich, U.S. Pat. No. 4,051,820 Boyesen and U.S. Pat. No. 4,067,302 Ehrlich all show inlet valves into the transfer passage without flow control for engine speed. In addition in U.S. Pat. No. 4,067,302 Ehrlich states "the air employed to scavenge the cylinder 215 can also be used to ignite unburned combustibles in the exhaust system and thereby to produce an engine with cleaner emission". This clearly demonstrates that gaseous fuel mixture is also used in the cylinder scavenging process.

U.S. Pat. No. 4,481,911 (Sheaffer et al.) discloses a two stroke engine which has the detriment of having gaseous fuel residual in the transfer passage 11 from the previous cycle. Even with air inducted into the central transfer passage 11 as shown at 25, residual gaseous fuel remains at the transfer port end of the transfer passage 11. Consequently, this engine does not have air scavenging of the transfer passage 11 and transfer port 12. Instead gaseous fuel mixture is residual in the transfer passage for the initial scavenging of the cylinder, this gaseous fuel mixture then passing through the exhaust port 16 and into the exhaust passage.

Japanese Patent 02125966-A (Komatsu Zenoah) discloses in FIGS. 1 and 2 an engine which has the problem of residual gaseous fuel mixture in scavenging passage 9 from the previous cycle which is not scavenged at the transfer port end of the scavenging passage 9 by the incoming air. This has the result of gaseous fuel mixture initially scavenging the cylinder and flowing through the exhaust port and into the exhaust passage 13 thus producing additional exhaust emissions. Similarly, the arrangement of FIG. 3 has the problem of residual gaseous fuel mixture in the scavenging passage 9, and in the transfer port 9*a* and in the air supply passage 10 and 10*a*. When the piston 4 compresses the gaseous fuel mixture in the crankcase 5, it also compresses the air in the scavenging passage 9 and in the air passage 10. At the same time the crankcase pressure reverses the air flow, thereby causing backwards flow through the venturi of the carburettor 12. This reverse air flow draws extra fuel into the air stream as a gaseous fuel mixture and up into a portion of air supply tube 10. Because of the compression of the gaseous fuel mixture, the residual air in the scavenging passage 9 is forced into air passage 10 by gaseous fuel mixture from the crankcase 5. Thus the scavenging passage 9 is filled with a considerable quantity of gaseous fuel mixture. Hence when the piston 4 moves further towards bottom dead centre and the cylinder scavenging transfer port 9*a* is opened, the residual gaseous fuel mixture in the scavenge port 9 initially scavenges the cylinder and also flows into the exhaust port 13, thus producing additional exhaust emissions.

U.S. Pat. No. 4,075,985 (Iwai) discloses arrangements in FIGS. 1, 2, 3 and 8 that have the problem of residual gaseous fuel mixture, from the previous cycle, remaining in the corners at the combustion chamber end of the scavenging passages 16 and 25 and of the scavenging (transfer) ports 15 and 24 which are not scavenged by the air. Thus the initial cylinder scavenging is with residual gaseous fuel mixture.

The arrangement of FIGS. 1 & 8 also suffer from insufficient volume of the scavenging passages. Iwai's FIG. 6 shows the scavenging passages 16 connected to air branch passages 17A with reed valves 18 at the start of the air passages. The air branch passage 17A together with scavenging passages 16 form a larger volume but this larger volume in this configuration is detrimental as just prior to the opening of the transfer port 15 with the piston's downward thrust, the residual air in both the scavenging passage 16 and the air passage 17A is compressed back into the air passage leaving little or no air in the scavenging passage 16 for initial cylinder scavenging.

U.S. Pat. No. 4,253,433 (Blair) shows an extended transfer duct K into which the carburettor fuel is inducted through admission port F and check valve C.

Either fuel free air, or oiled air, is inducted into the crankcase through aperture G and check valve D. If the crankcase air is oiled, then this oiled air, and some fuelled air (as per line 33 & 34 of column 2) is used for initial cylinder scavenging which then proceeds unburnt into the exhaust muffler to add to the exhaust emissions. If the crankcase air is not oiled, then the engine will not function, as the piston and cylinder walls not being lubricated with sufficient gaseous fuel mixture will cause the engine to seize.

U.S. Pat. No. 4,708,100 (Luo) also discloses an engine which suffers from the problem of not being able to function due to a dry crankcase, cylinder and piston and subsequent seizing of the engine due to lack of internal (crankcase) lubrication as only fuel-free (and oil-free) air enters the crankcase.

U.S. Pat. No. 4,948,279 (Luo) also shows a two stroke engine with a complicated and costly rotary valve system which is rotated by gears, belts or chains, and uses compressed air provided by an external source (not shown).

PCT WO 00/43660 (Andersson et al) shows a cylinder (only) with a fresh air port 14 that requires external to the two stroke engine function an air compressing means to enable fresh air port 14 to function. This air compressing requirement means it does not function in synchronism with the pressure changes within the engine.

European Patent 0115758 (Rabl) also discloses a complicated engine which is costly to manufacture and provides insufficient cylinder scavenging by fuel free air to remove the combustion gases from the cylinder. It also suffers from the disadvantage that the air, when it is squirted through the small piston port into the underside of the piston, mixes with some of the gaseous fuel mixture from the remainder of the crankcase.

All of the above mentioned prior art two stoke engines (and cylinders) have other disadvantages in addition to those mentioned above. These are firstly, insufficient volume in their transfer passages to retain residual air for the next cylinder scavenging cycle, and insignificant retention of air, if any, in the cylinder when their exhaust ports are closed.

Secondly, they all have their combustion chambers in the centre or near centre of the cylinder. Thus, on cylinder compression the cylinder contents will not compress rotatingly and turbulently with any possible retained air to uniformly mix with the gaseous fuel mixture in the combustion chamber zone. This shows that they do not retain any significant amount of fuel free air in the cylinder after the exhaust port is closed.

Also all of the above mentioned prior art two-stroke engines (and cylinders) have the additional drawback of requiring the regular quantity of oil in the oil/gasoline fuel mixture, this regular quantity of oil being burnt and exhausted into the atmosphere thus adding to the exhaust emissions.

In many jurisdictions there has been, or will be, an increase in standards in relation to pollution which must be met by two stroke engines. In the United States the Environmental Protection Authority (USAEPA) and in California the Air Resources Board (CARB) are increasingly requiring more stringent standards as time goes by.

The object of the present invention is to provide a crankcase scavenging two stroke internal combustion engine, and a method of operating same, which retains the inherent low cost construction, simplicity and function of a conventional two stroke engine, but which enables the cylinder to be scavenged by fuel free air thereby substantially reducing the amount of any fuel which finds its way unburnt into the exhaust and also reducing the oil requirement for the oil/gasoline fuel mixture, and hence reducing oil consumption.

SUMMARY OF THE INVENTION

In accordance to the first aspect of the present invention there is disclosed a crankcase scavenging two stoke internal combustion engine comprising:

an exhaust port openable and closable by a piston reciprocally mounted in a cylinder, said piston being operable to alternatively pressurise and depressurise a crankcase relative to atmospheric pressure, a transfer passage interconnecting said crankcase and cylinder and having a transfer port opening into said cylinder, said transfer port being both openable and closable by the reciprocal movement of said piston, said transfer port being openable after opening of said exhaust port and being closable before closing of said exhaust port; a fuel means to supply fluid fuel into said crankcase and communicating with said crankcase, an air inlet having a unidirectional air inlet valve connected to said transfer passage, said valve being closely adjacent said transfer port, and said air inlet being provided with an adjustable flow controller to adjust the magnitude of air flow through said air supply inlet and thereby adjust engine speed, wherein said transfer passage has a volume which is a substantial fraction of the swept volume of said cylinder, and said air inlet valve is orientated to open towards said transfer port to thereby sweep substantially fuel free air into and past said transfer port and continue into said transfer passage when said crankcase is depressurized, and close said air inlet valve when the crankcase pressure substantially equals or exceeds atmospheric pressure; whereby the substantially fuel free air swept into said transfer passage towards said transfer port blows out of said transfer port and passage the residual gaseous fuel mixture remaining therein from the previous cycle and substantially fills said transfer port and passage with substantially fuel free air which subsequentially is admitted into said cylinder to scavenge same when said transfer port is opened following opening of said exhaust port, some of said air, after scavenging said cylinder, flowing into said exhaust port, and the remainder of said scavenging air remaining in said cylinder following closure of said exhaust port.

In accordance with a second aspect of the present invention there is disclosed a method of operating the crankcase scavenging two stroke internal combustion engine comprising the steps of:

moving said piston to close said transfer port; continuing said piston movement to close said exhaust port to thereby compress the contents of said cylinder and to simultaneously depressurise said crankcase; permitting said air inlet valve to open and introducing substantially fuel free air into said transfer passage towards said transfer port, to blow out of said transfer port and passage any residual fuel/air mixture from a previous cycle; igniting said compressed contents of said cylinder and reversing the movement of said piston; continuing the movement of said piston to close said air inlet valve and pressurise said crankcase; continuing the movement of said piston to open said exhaust port; continuing the movement of said piston to open said transfer port to thereby permit substantially fuel-free air therein to enter and scavenge said cylinder; continuing movement of said piston so that some of said substantially fuel free air enters said exhaust port; continuing the movement of said piston to introduce at least some of the contents of said crankcase into said cylinder via said transfer passage and port to thereby charge said cylinder; continuing said movement of said piston to close said transfer port and said exhaust port; continuing the movement of said piston to mix said substantially fuel free air remaining in said cylinder with said charged cylinder contents; igniting the contents of said cylinder; and repeating the above steps in sequence whilst introducing fluid fuel into said crankcase.

In accordance with a third aspect of the present invention there is disclosed a method of operating a two stroke internal combustion engine to reduce the oil consumption thereof, said method comprising the steps of:

locating a transfer passage between the engine crankcase and engine transfer port, the volume of said transfer passage; being an appreciable fraction of the volume of the swept volume of the cylinder of said engine, after said transfer port closes, scavenging said transfer port and said transfer passage with substantially fuel free air, after said transfer port opens, scavenging said combustion chamber with said substantially fuel free air from said transfer passage, retaining some of said substantially fuel free combustion chamber scavenging air in said combustion chamber to contribute to the combustion gases, and reducing the oil content of the fuel/oil mixture introduced into said crankcase.

In accordance with a fourth aspect of the present invention there is disclosed a method of increasing the richness of the gaseous fuel mixture of a two stroke internal combustion engine at starting, said method comprising the steps of:

locating a decompression valve communicating with the cylinder of said engine adjacent the exhaust port thereof, locating a transfer passage between the cylinder crankcase and engine transfer port, the volume of said transfer passage being an appreciable fraction of the swept volume of said cylinder, after said transfer port closes, scavenging said transfer port and said transfer passage with substantially fuel free air, after said transfer port opens, scavenging said cylinder with said substantially fuel-free air from said transfer passage, closing said exhaust port and charging said cylinder via said transfer port with a gaseous fuel mixture from said crankcase, and maintaining said decompression valve open whilst compressing the contents of said cylinder to expel therefrom some of said substantially fuel free scavenging air otherwise remaining therein, to thereby deplete the air content of said cylinder and is increase the richness of the compressed fuel mixture.

BRIEF DESCRIPTION OF THE DRAWINGS

One preferred embodiment of the present invention will now be described with reference to the drawings which illustrate a single cylinder cross flow crankcase scavenging two stroke internal combustion engine.

In the drawings.

DETAILED DESCRIPTION

Figure 1:
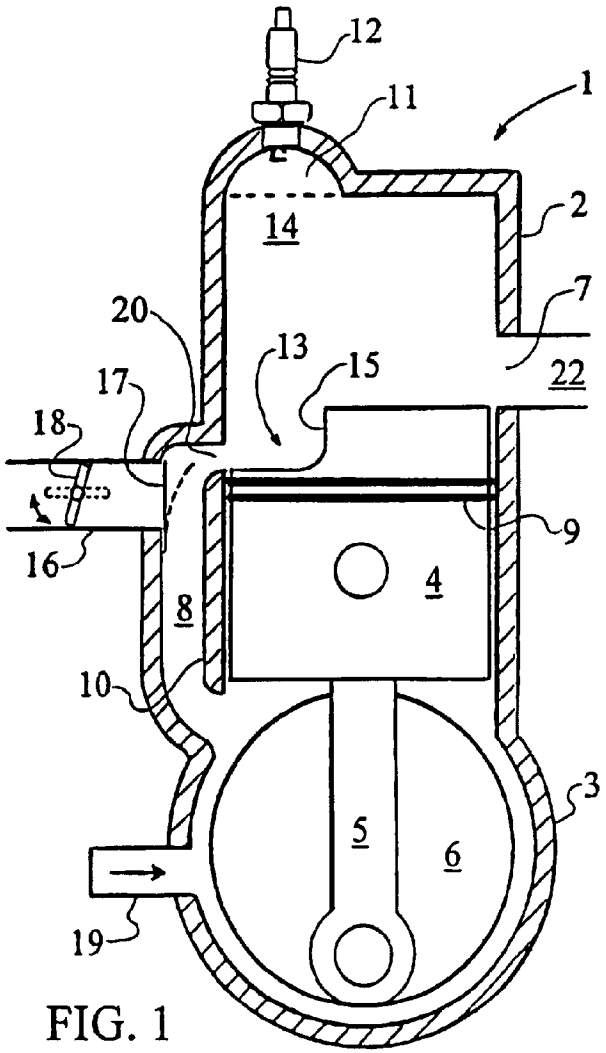
FIG. 1 is a schematic cross-sectional illustration of the engine construction illustrating the basic principle of the invention.

As seen in FIG. 1, the engine 1 has a cylinder 2 and a crankcase 3. A piston 4 is reciprocally mounted within the cylinder 2 and connected by a connecting rod 5 to a crank shaft 6 in substantially conventional fashion.

Also substantially conventionally arranged is an exhaust port 7, an exhaust passage 22, a transfer passage 8 and a transfer port 20. The piston 4 is provided with one or more sealing piston rings 9. The piston 4 sequentially opens and closes the exhaust port 7 and transfer port 20 in conventional fashion. A side wall 10 of the cylinder 2 forms part of the transfer passage 8. The exhaust port 7 permits exhaust gas to flow out of the cylinder 2 and into the exhaust passage 22.

Also in known fashion, the head of the cylinder 2 can be provided with a recess 11 into which is mounted a spark plug 12. The recess 11 is located opposite to, and faces, a hollow 13 formed in the upper surface of the piston 4. An air scavenging deflector 15 of the piston 4 is formed from the vertical wall of the recess 13. The recess 11 and hollow 13 together constitute the major volume of a combustion chamber 14 as illustrated. However, the top of the cylinder 2 can also be flat as shown in FIG. 1 with the flat dotted lines, and as illustrated in FIGS. 2 to 7 & 10. With a flat head cylinder, the hollow 13 of the piston 4, forms the combustion chamber. The flat cylinder head results in the spark plug 12 being in a lower position. Such a cylinder, having at least a majority of its head flat in the area adjacent the exhaust port, has the advantage of allowing a very large proportion of fuel free air to be compressed sideways whereby the air is being rotatingly and turbulently mixed with the small portion of enriched high density gaseous fuel mixture in the hollow 13 of the piston 4. This produces the correct air/fuel ratio for efficient combustion.

In a major departure from conventional practice, as seen in FIG. 1, an air supply tube 16 connects to the transfer passage 8 close to the transfer port 20 at the combustion chamber end of the transfer passage 8 by means of a reed valve 17. The reed valve 17, when opened, directs the incoming air in a scavenging route to remove from the transfer port 20 and transfer passage 8 any residual gaseous fuel mixture that remains in the transfer port 20 and transfer passage 8 from the previous cycle. A flow control mechanism, such as a butterfly valve 18, is located in the air supply tube 16. A slide valve plate (not illustrated) or any air flow controlling device can be used instead of the butterfly valve 18, if desired. The butterfly valve 18 controls engine speed.

A fuel injector 19 is mounted on the crankcase 3 and directly injects into the crank case 3. The fuel injector 19 can take the form either of a liquid fuel injector, a gaseous fuel injector, or a carburettor with a unidirectional reed valve. Any of these engine fuel feeding means can be located anywhere in the crankcase, or even on the cylinder with conventional piston porting (not illustrated) allowing fluid fuel to feed into the crankcase. Any location as mentioned can be used that contributes to optimum crankcase fuel/air mixing for particular engine uses.

As indicated by dotted lines in FIG. 1 the reed valve 17 is able to move to the right when the pressure in the crankcase 3 is less than atmospheric pressure. Thus the engine admits air through the air supply tube 16 past the butterfly valve 18 and past the reed valve 17. This causes the air to be directed towards transfer port 20 and the combustion chamber end of the transfer passage 8. This fuel free air scavenges the residual gaseous fuel mixture of the previous cycle from the transfer port 20 and the transfer passage 8, and returns the residual gaseous fuel mixture from the previous cycle back into the crankcase 3. After this transfer port and transfer passage scavenging occurs, additional fuel free air flows into the transfer passage 8 and flows into the crankcase 3.

However, when the pressure in the crankcase 3 equalises with, or becomes greater than atmospheric pressure, the reed valve 17 moves into the position illustrated as a solid line in FIG. 1 and therefore blocks the air supply tube 16.

The butterfly valve 18 is moveable as indicated by a double headed arrow in FIG. 1 so as to regulate the volume of air flowing in this fashion through the air supply tube 16. In this way the engine speed is regulated. Where a carburettor is used as the injector 19, the inlet air control valve of the carburettor (not illustrated) is linked or ganged to operate in concert with the valve 18. Depending on the type of fuel injector used, the fuel injector is also able to be linked to valve 18. The fuel injector can also be operated electronically, or mechanically, or by a combination of both.

As a consequence to the above described arrangement, when the piston 4 moves upwardly on the compression stroke and closes both the transfer port 20 and exhaust port 7 to the cylinder 2, the crankcase 3 is depressurized in conventional fashion relative to atmosphere causing the reed valve 17 to open. Thus fuel free air is introduced into the transfer port 20 and the transfer passage 8 and moves therethrough into the crankcase 3. However, as a result of the action of the injector 19, the atmosphere within the remainder of the crankcase 3 comprises the traditional two stroke fuel/air mixture as a gaseous fuel mixture. However, the gasoline/oil mixture injected into the crankcase 3 is preferably a richer than normal fuel/air mixture, to balance the fuel free air that is transferred into the cylinder 4. Thus, collectively within the combustion chamber 14 the correct uniformly mixed gaseous air fluid fuel ratio (of approximately 14.7:1) is achieved for combustion.

As the piston 4 moves downwardly on the power stroke, the exhaust port 7 is first opened and the pressurised combustion gases are initially permitted to escape into the exhaust port 7 and exhaust passage 22. The continued downwardly motion piston 4 opens the transfer port 20 and an inrush of the fuel free air from the transfer passage 8 through the transfer port 20 and into the cylinder 2 takes place. The volume of fuel free air previously residually contained within the transfer passage 8 is then followed by the gaseous fuel mixture from the crankcase 3. As a consequence, the scavenging of the cylinder 2 takes place with fuel free air and this inrush of fuel free air is deflected by the piston deflector 15 up to the cylinder head, across and down the cylinder walls as well as across the piston and thus pushes the remaining exhaust gases out the exhaust port 7. Some of this fuel free air also flows into the exhaust passage 22. The amount of air that passes into the exhaust passage 22 can be varied with the engine design to be between almost zero and a substantial volume.

Importantly, essentially none of the gaseous fuel mixture reaches the exhaust port 7. Consequently, on the succeeding compressing stroke, the fuel free air between the cylinder head and piston 4 adjacent to the exhaust port 7, is compressed towards, and rotationally and turbulently mixed with, the more recently arrived rich gaseous fuel mixture in and above the hollow 13 of the piston 4. Therefore on complete cylinder compression, and adjacent to the spark plug, is the compressed gaseous fuel mixture in the hollow 13 of piston 4 substantially uniformly mixed to the correct fuel/air ratio for efficient combustion.

The entire cycle of the two stroke engine will be described with reference to FIGS. 2–5 in which the position of fuel free air is illustrated with unfilled circles, the position of gaseous fuel mixture is illustrated with solid triangles; and the position of exhaust and combustion gases is illustrated with solid squares.

Figure 2:
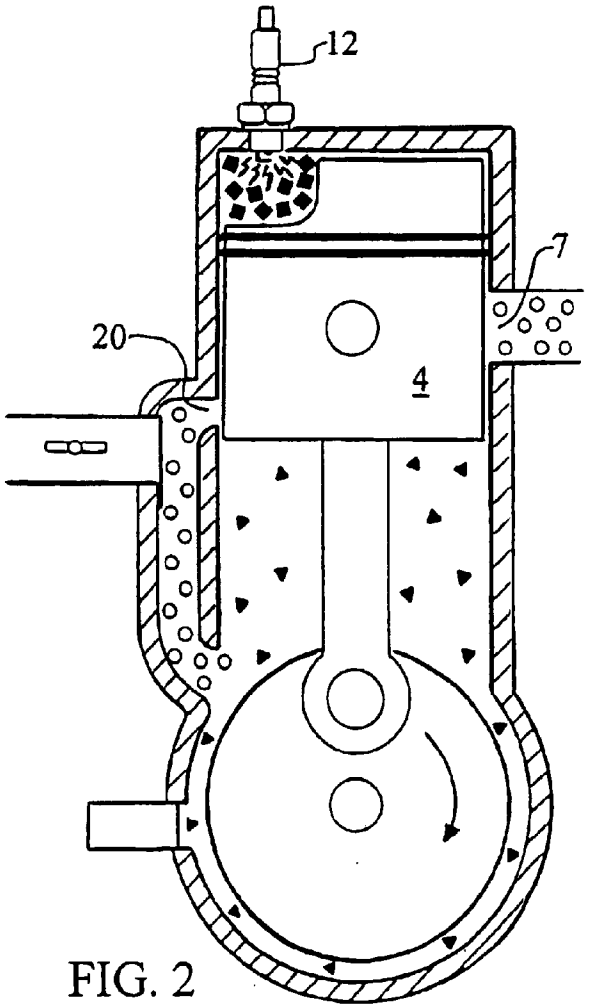
FIGS. 2–7 are similar views but each illustrating the position of the piston during various stages of the engine cycle.
Figure 4:
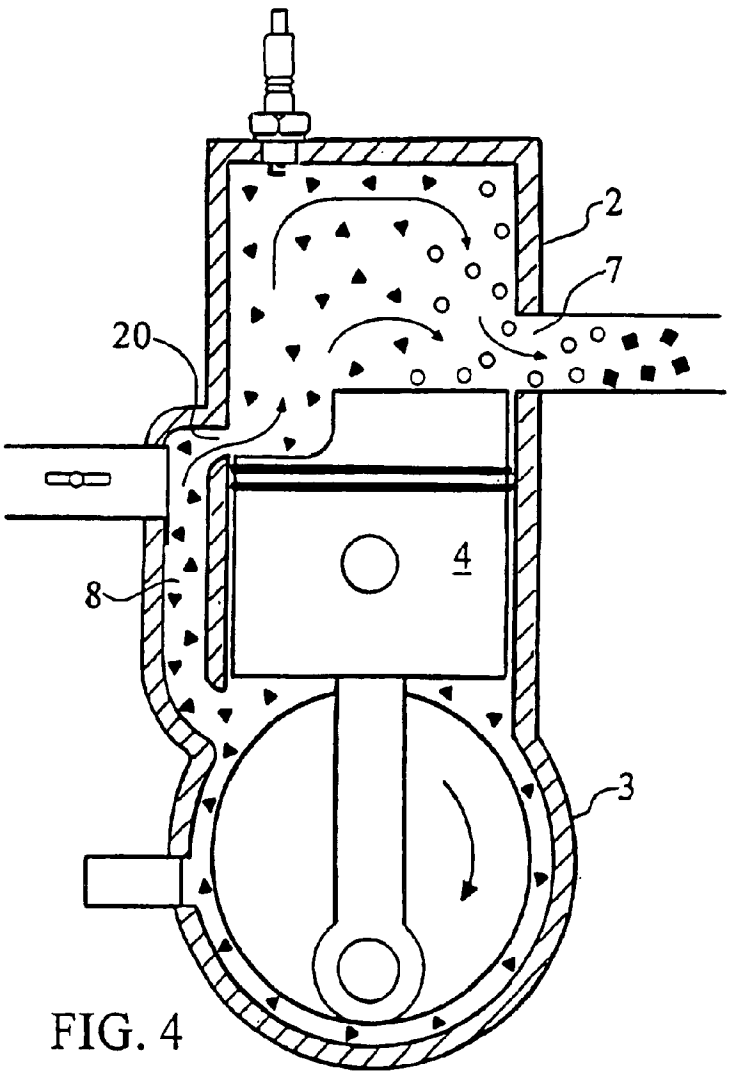

In FIG. 2 the piston 4 is at top dead centre and the spark plug 12 has fired so that the expanding gases commence forcing the piston 4 downwardly towards the bottom dead centre position illustrated in FIG. 4. Both the exhaust port 7 and transfer port 20 are closed by the piston 4.

Figure 3:
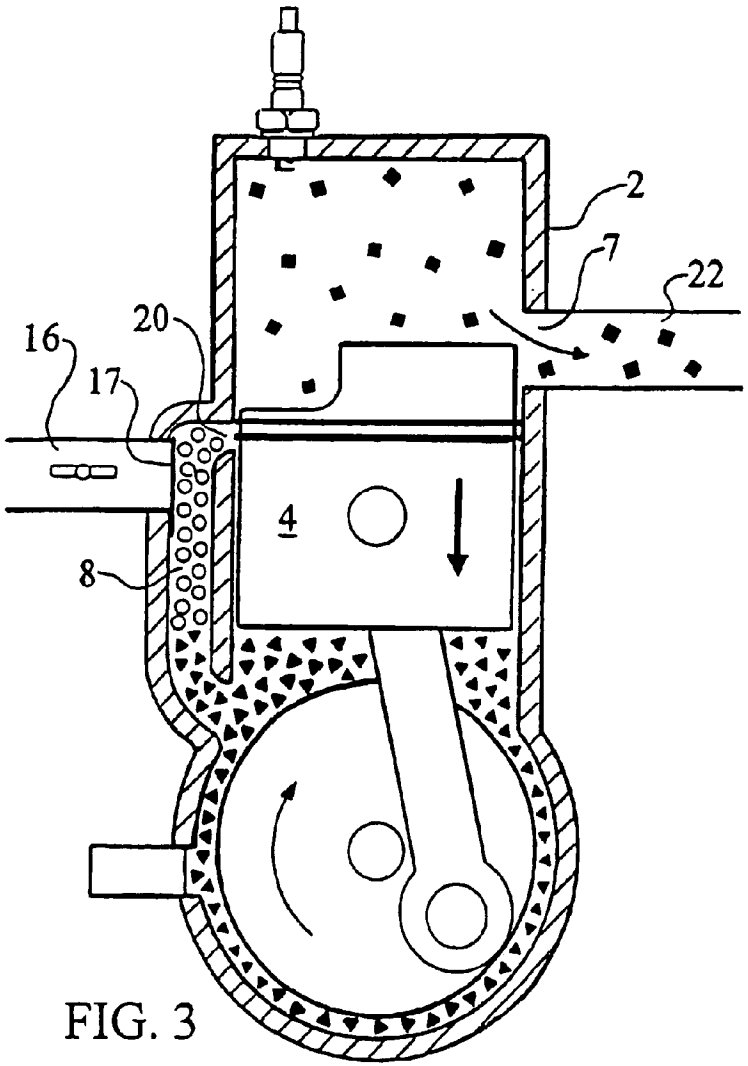

In FIG. 3 the piston has moved further downwardly and the exhaust port 7 has opened thereby allowing exhaust gases to exit the cylinder 2 into the exhaust passage 22. During the movement of the piston 4 as illustrated in FIG. 3, when the reed valve 17 is closed, air ceases to flow through the air supply tube 16 and into the transfer passage 8. Thus fuel free air remains within the transfer passage 8 separated from the gaseous fuel mixture and residually awaits the opening of the transfer port 20 by the piston 4 to commence the cylinder scavenging action.

As also illustrated in FIG. 3, the gaseous fuel mixture in the crankcase is compressed, as is the fuel free air in the transfer passage 8. To optimize the stratified separation of fuel free air from the gaseous fuel mixture of the crankcase, a broad width narrow depth and long length (or extended length) transfer passage 8 is preferred.

As shown in FIG. 4, as the piston 4 has continued its downward movement to bottom dead centre, the transfer port 20 has fully opened thereby permitting the voluminous charge of fuel free air previously residually contained within the transfer passage 8 to scavenge the cylinder 2. In this position with the piston 4 at bottom dead centre, both the exhaust port 7 and the transfer port 20 are completely open, and the volume of the crankcase is at a minimum. Thus gaseous fuel mixture from the crankcase 3 is finally transferred into the cylinder 2 via the transfer passage 8 and transfer port 20.

Figure 5:
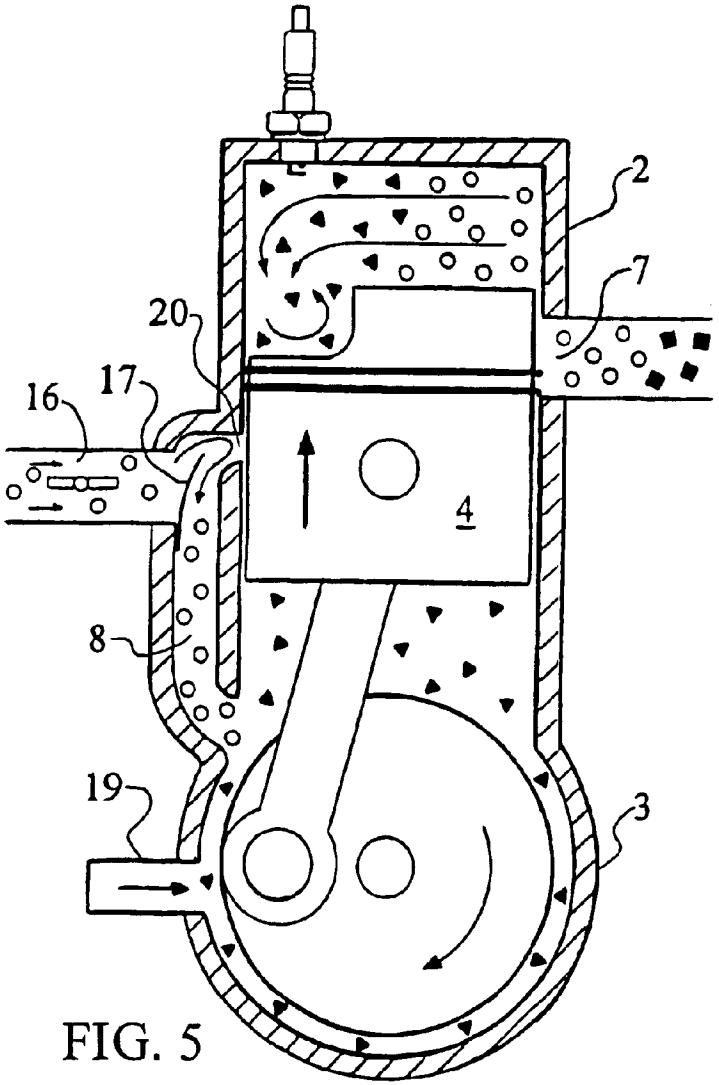

In the position illustrated in FIG. 5, the cylinder compression stroke has commenced and both the exhaust port 7 and transfer port 20 are closed to the cylinder 2. The volume of the crankcase 3 is expanding thereby lowering the pressure within the crankcase 3. As a consequence, the reed valve 17 has opened and air flows through the air supply tube 16, towards the transfer port 20, sweeps past the transfer port 20 and continues into the transfer passage 8. This flow simultaneously scavenges (blows away) all residual gaseous fuel mixture from the transfer port 20 and the transfer passage 8 into the crankcase 3. Note that if the reed valve 17 were inverted from the position illustrated in FIG. 5, the transfer port 20 and transfer passage 8 would not be swept clear of all residual gaseous fuel mixture, because there would be a pocket of gas immediately adjacent the transfer port 20 which would not be swept clear. This is a defect of prior art engines.

The fuel injector 19 is preferably operated at the stage of the cycle illustrated in FIG. 5 (and FIG. 7) where the crankcase pressure is being decreased. As a consequence, the air entering the crankcase 3 via the air supply tube 16 and transfer passage 8 is able to swirl around the crankcase thus contributing to good gaseous mixture of fuel with air in the volume of the crankcase 3.

Figure 6:
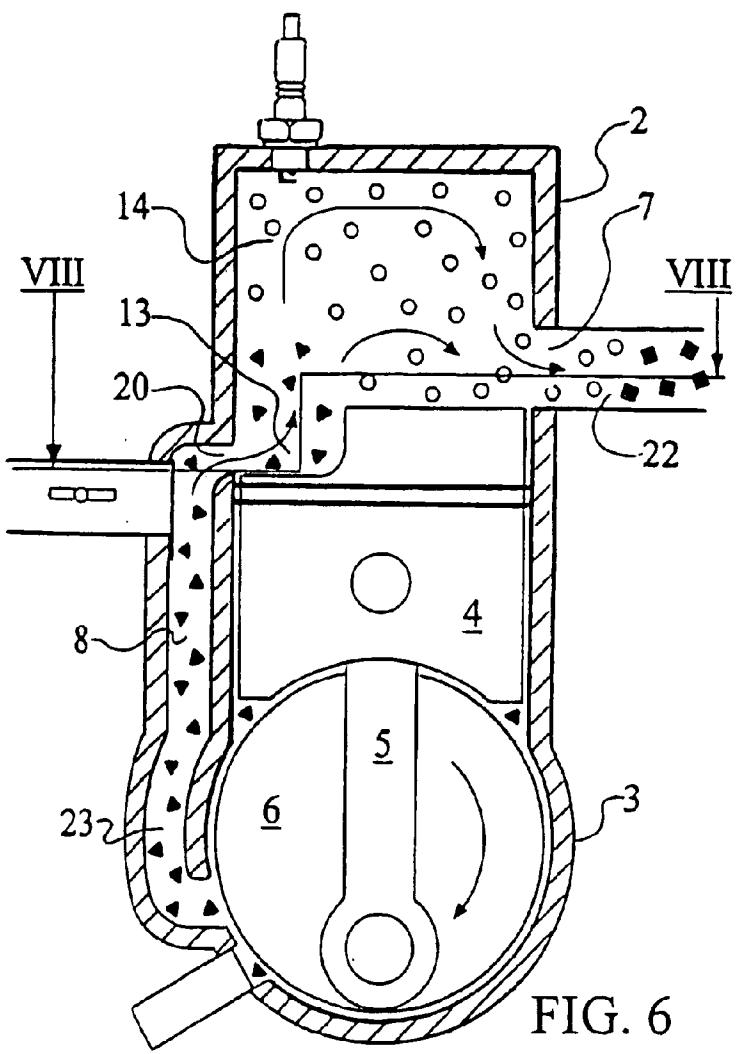

A second embodiment in the form of an extended transfer passage engine is shown in FIG. 6. For both embodiments, the opening of the transfer passage 8 into the crankcase 3 is located entirely beyond (below in the drawings) the piston 4 when the piston 4 is at bottom dead centre. In FIG. 6, the piston 4 is at bottom dead centre and the combustion gases have already been scavenged from the cylinder 2 by fuel free air, some of which is also passing through the exhaust port 7 and into the exhaust passage 22. The amount of fuel free air that passes into the exhaust passage 22 can be varied with the engine design between almost zero and a substantial volume.

However, the extended transfer passage 23, allows an even a greater volume of residual fuel free air to be transferred into the cylinder 2. As a result, more fuel free air is retained in the cylinder 2 after the exhaust gases have been scavenged by the incoming charge of fuel free air and after the exhaust port 7 is closed.

At this position of bottom dead centre, a small charge of enriched gaseous fuel mixture from the crankcase 3 is exiting from transfer port 20 and into the cylinder 2 above the hollow 13 of the piston 4.

Figure 7:
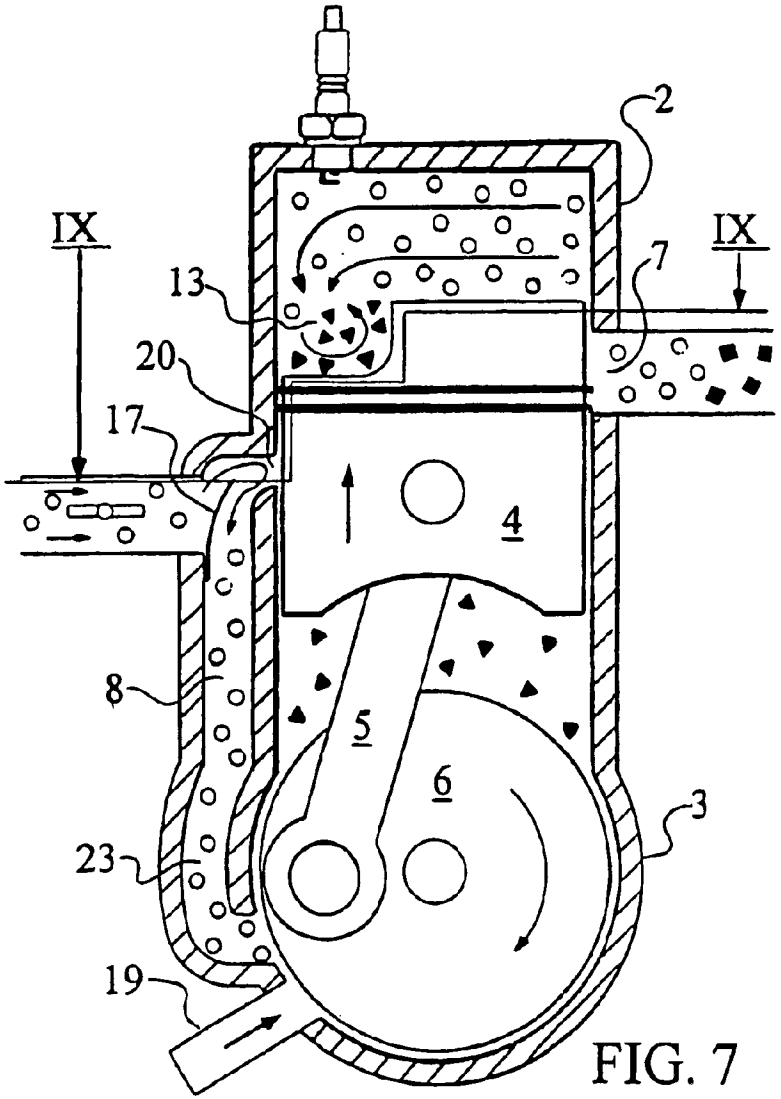

The engine having the extended transfer passage 23 is also shown in FIG. 7 but with the cylinder compression stroke occurring so the transfer port 20 and exhaust port 7 respectively are closed, to and from, the cylinder 2. As is illustrated, the compression and rotating turbulence created in and above the hollow 13 of the piston 4 mixes the fuel free air and the rich gaseous fuel mixture into a uniform and normal air/fluid fuel ratio (of approximately 14.7:1)for efficient combustion.

Because the transfer port 20 is closed, the pressure in the crankcase 3 has decreased and the reed valve 17 has opened with fuel free air flowing into the transfer port 20 and extended transfer passage 23 and into the crankcase 3.

With the extended transfer passage 23 having a large volume, this results in even more fuel free air being placed above the piston 4 (say 30% to 80% but preferably 75% of total swept cylinder volume) with the remaining 25% of volume being a rich gaseous fuel mixture (4 times richer than normal ie approx. 3.7:1 air/fluid fuel ratio). This results in an enriched gaseous wet sump two stroke engine and therefore allows a decrease of up to 75% or more of oil requirement in the enriched gaseous fuel mixture (oil/gasoline/air mixture) for lubrication of crankshaft bearings and the piston/cylinder walls. This occurs because only part scavenging occurs of the crankcase, thus retaining a considerable quantity of higher density enriched gaseous fuel mixture (oil/gasoline/air mixture). Therefore the oil component, of this oil/gasoline fuel mix, can be reduced in its normal crankcase quantity requirement compared with a conventional engine using a conventional oil/gasoline mixture (say, a 1:50 oil/gasoline mix). Therefore using the same grade of oil, the oil/gasoline ratio can be reduced from 1:50 to, say, 1:200 ratio. This would result in a very substantial reduction in oil consumption and therefore greatly reduce burnt oil product emitted as part of the exhaust gases.

This dramatic reduction of oil burnt also results in much lower carbon buildup; on the spark plug, piston and cylinder head; in the exhaust muffler; and on the spark arresting gauze of the exhaust muffler. Furthermore, there is a considerable saving in oil as a resource, and of its cost to the operator.

The above example of oil reduction using 1:50 grade two stroke oil also applies to other grades of oils including for example, 1:25 grade two stroke oil, and with the same percentage reduction achieved.

The above examples of oil reduction by 75% are due to the extra large volume of the extended transfer passage and its extra volume of residual fuel free air. However, even without the extended transfer passage 23, the volume of the air transfer passage 8 (being of greater volume than the transfer passage of conventional two stroke engines) also results in the retention within the cylinder of a significant volume of fuel free air. Therefore if 20% of the total swept volume of the cylinder has retained air after the exhaust port closes, then the fuel/air mixture can be made 1.25 times richer, thus enabling a corresponding reduction in oil requirement of 20% which is still a significant reduction.

Therefore the percentage reduction in oil requirement in the fuel mixture corresponds to the percentage of the swept volume of the cylinder occupied by retained fuel free air. For example, 10% air retention in the cylinder equals 10% reduction in oil requirement, 20% fuel free air retention in the cylinder equals 20% reduction in oil requirement, 30% fuel free air retention in the cylinder equals 30% reduction in oil requirement, etc.

Since some scavenging fuel free air can be lost out the exhaust port it is desirable to have a larger volume transfer passage, to contain residual fuel free air, when determining the air retained in the cylinder when the exhaust port is closed. Hence a transfer passage with a total volumetric capacity of say 20% of the swept volume of the cylinder can result in say a 10% retention of fuel free air in the cylinder. A transfer passage with total volumetric capacity of say 50% of the swept volume of the cylinder can result in say a 40% retention of fuel free air in the cylinder, etc. The fuel fee air loss into the exhaust passage can be varied according to engine design so the 10% example given is to be understood as a nominal amount.

Figure 8:
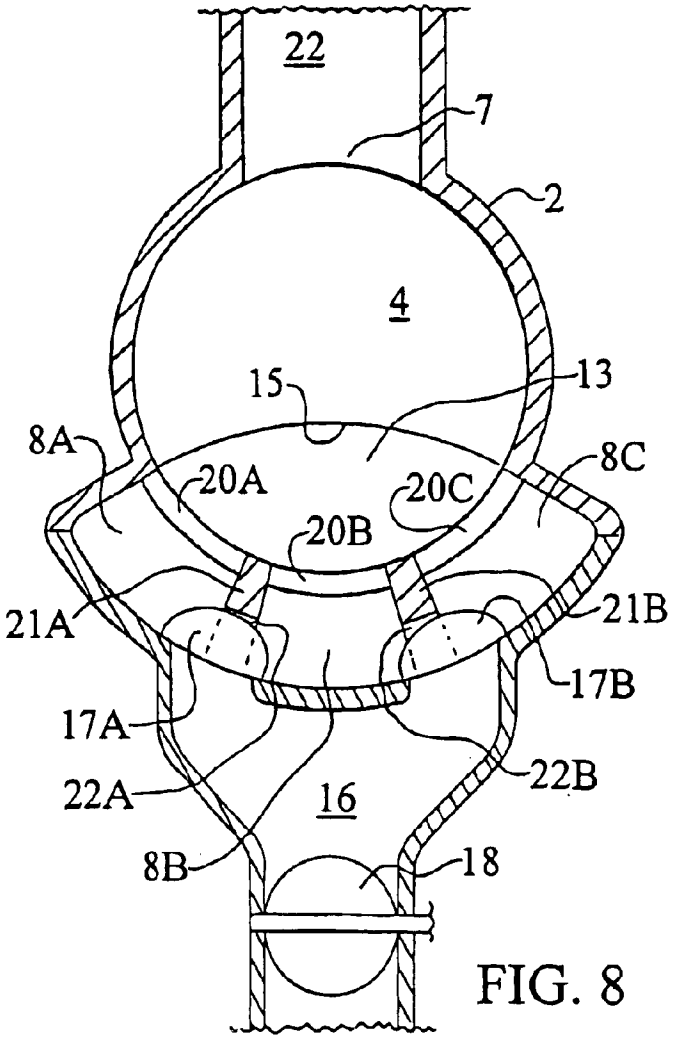
FIG. 8 is a cross section of the cylinder, taken along the line VIII—VIII of FIG. 6, but with the reed valves 17A & 17B illustrated in the open position.

Turning now to FIG. 8, the air supply tube 16 of either embodiment is illustrated with its butterfly valve 18 in the open position. Similarly two reed valves 17A & 17B are in their open position. The transfer port 20 has three openings 20A, 20B & 20C, into the cylinder 2. The piston deflecting wall 15 is arcuate when viewed in plan.

Figure 9:
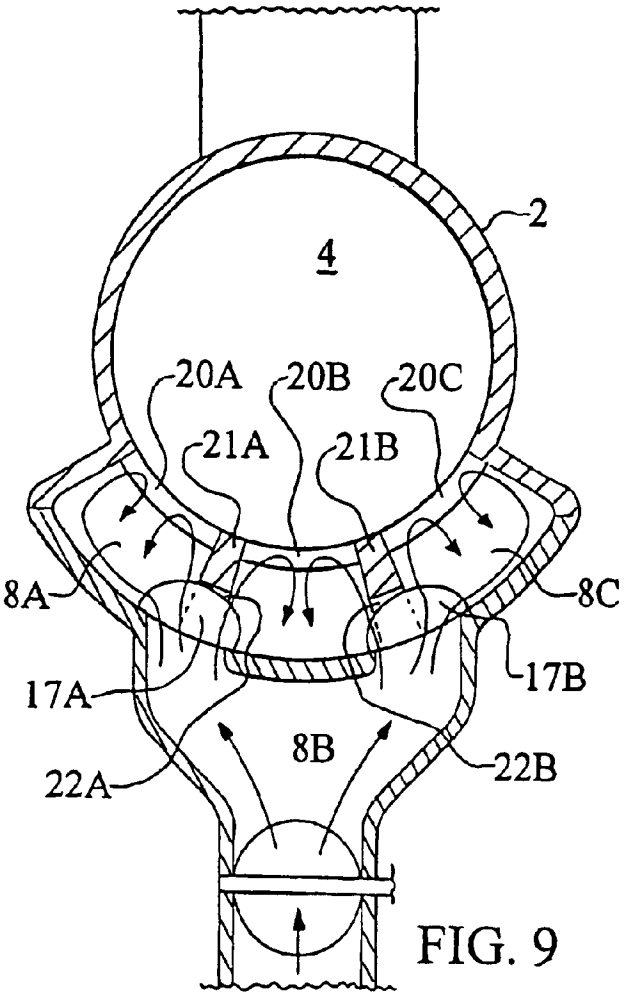
FIG. 9 is a cross-section along the line IX—IX of FIG. 7 and shows indicative flow paths of air scavenging the transfer ports and the combustion chamber ends of the transfer passages.

FIG. 9 is a similar cross-section to that of FIG. 8 but showing the piston 4 in a raised position, thereby closing the transfer ports 20A, 20B & 20C. The air flow paths during air scavenging of the transfer ports 20A, 20B & 20C, and of the combustion chamber ends of the transfer passages 8A, 8B & 8C are indicated by the arrows in FIG. 9 (and also FIGS. 5 & 7). The two dividing walls 21A & 21B which divide the transfer passage 8 into three transfer passages 8A, 8B & 8C, have cut-outs 22A, 22B opposite the reed valves 17A & 17B which allows room for the said valves 17A & 17B to open. The dividing walls 21A & 21B can be any vertical extent along the transfer passage 8.

Referring to FIG. 8, when the crankcase 3 is in the compression stage and the transfer ports 20A, 20B & 20C to the cylinder 2 are opened by the piston 4, the three transfer passages 8A, 8B & 8C together with the two dividing walls 21A & 21B direct the flow of fuel free air onto the deflector wall 15 of the piston 4 to efficiently scavenge the cylinder 2 of its combustion gases. The cut-outs 22A and 22B can also limit the degree or extent to which the reed valves 17A & 17B can open, if desired.

As seen in FIGS. 6 and 7, the extended transfer passage 23 increases the total compressible volume of the crankcase 3. This can result in a slight reduction of total crankcase compression when the piston is at bottom dead centre. If desired, this small deficiency can be overcome by using a full circle crankshaft 6 and by having a minimum distance between the full circle crankshaft and the crankcase 3, as well as having a shorter connecting rod 5. This maximises crankcase compression. Even though this extra crankcase compression is not necessary for the invention to function, an engine so arranged can optimise its reduction in oil requirement.

In the event that the fuel injector 19 is a carburettor, a reed valve (similar to valve 17) needs to be inserted between the crankcase 3 and carburettor to prevent the crankcase, when pressurised, venting via the carburettor. This requirement is well known to those skilled in the art. However, if the carburettor is piston ported in conventional fashion (not illustrated) then the carburettor may not require a reed valve.

Figure 10:
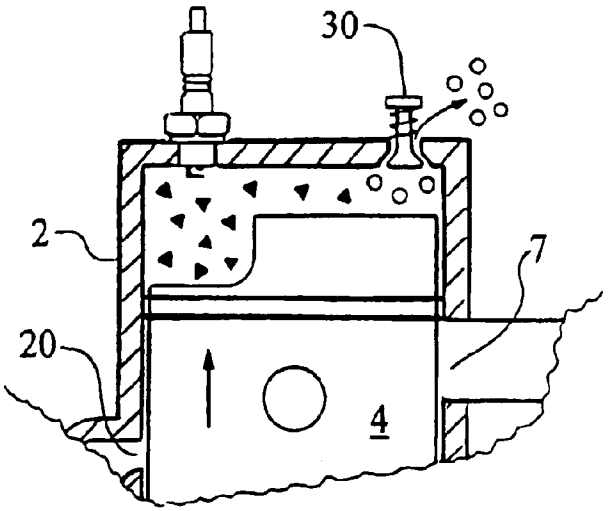
FIG. 10 is a schematic cross-sectional view illustrating a decompression valve in its open position for starting.

FIG. 10 shows the piston in the compression of cylinder phase, in the starting situation with the decompression valve is open to release the air from the cylinder.

In the arrangement illustrated in FIG. 10, a substantially conventional spring loaded decompression valve 30 is provided on the cylinder 2. The valve 30 is preferably located in the cylinder head and adjacent to the exhaust port 7. The valve 30 provides two important functions. The first is the conventional function of reducing the compression ratio at starting and thus making the engine easier to crank. The second function is to provide an increase in fuel of the fuel/air ratio at starting. This second function arises because the gas exiting the cylinder 2 via the decompression valve 30 is largely fuel free air.

As a consequence, the volume of fuel free air in the combustion chamber is substantially reduced but the volume of enriched gaseous fuel mixture that has entered the cylinder 2 via the transfer ports 20 (which are located on the opposite side of the cylinder 2 from the decompression valve 30) is not reduced. Thus the proportion of fuel in the fuel/air ratio is increased and a much richer gaseous fuel mixture results for starting of the engine. This is the equivalent of a traditional choke arrangement but achieved in another way.

The foregoing describes only some embodiments of the present invention and modifications, obvious to those skilled in the art, can be made there to without departing from the scope of the present invention. For example, the extension of the above described principles to multi-cylinder engines will be straight forward to those skilled in the internal combustion engine arts.

The engines described above use a cross flow piston design. This piston design can be configured with additional radii and/or chamfers and shapes. Similarly the same principles of transfer port scavenging with the large transfer passage volume of residual fuel free air for efficient cylinder scavenging for low exhaust emissions can also apply to loop scavenged (non-crossflow) ported engines as can the reduction in oil requirement. Rotation of the engine can be either clockwise or anticlockwise. The term "comprising" as used herein is used in the inclusive sense of "having" or "including" and not in the exclusive sense of "consisting only of". The illustrations are not necessarily to scale, and dimensional changes can be made without effecting the scope of this invention. The crankshaft illustrated is a full circle crank but any other shape can be used without affecting the scope of this invention. For simplicity, the illustrations of the engine have been shown without cooling means. The cooling means can be in conventional fashion either with air cooling or with liquid cooling.

What is claimed is:

1. A crankcase scavenging two stoke internal combustion engine comprising: an exhaust port openable and closable by a piston reciprocally mounted in a cylinder, said piston being operable to alternatively pressurise and depressurise a crankcase relative to atmospheric pressure, a transfer passage interconnecting said crankcase and cylinder and having a transfer port opening into said cylinder, said transfer port being both openable and closable by the reciprocal movement of said piston, said transfer port being openable after opening of said exhaust port and being closable before closing of said exhaust port; a fuel means to supply fluid fuel into said crankcase and communicating with said crankcase, an air inlet having a unidirectional air inlet valve connected to said transfer passage, said valve being closely adjacent said transfer port, and said air inlet being provided with an adjustable flow controller to adjust the magnitude of air flow through said air supply inlet and thereby adjust engine speed, wherein said transfer passage has a volume which is a substantial fraction of the swept volume of said cylinder, and said air inlet valve is orientated to open towards said transfer port to thereby sweep substantially fuel free air into and past said transfer port and continue into said transfer passage when said crankcase is depressurized, and close said air inlet valve when the crankcase pressure substantially equals or exceeds atmospheric pressure; whereby the substantially fuel free air swept into said transfer passage towards said transfer port blows out of said transfer port and passage the residual gaseous fuel mixture remaining therein from the previous cycle and substantially fills said transfer port and passage with substantially fuel free air which subsequentially is admitted into said cylinder to scavenge same when said transfer port is opened following opening of said exhaust port, some of said air, after scavenging said cylinder, flowing into said exhaust port, and the remainder of said scavenging air remaining in said cylinder following closure of said exhaust port.

2. The engine as claimed in claim 1 wherein said transfer passage has an opening into said crankcase which is positioned entirely beyond said piston when said piston is at bottom dead centre.

3. The engine as claimed in claim 2 wherein said opening of said transfer passage into said crankcase is located above the axis of rotation of the crankshaft of said engine.

4. The engine as claimed in claim 2 wherein said opening of said transfer passage into said crankcase is located below the axis of rotation of the crankshaft of said engine.

5. The engine as claimed in claim 1 wherein said inlet valve comprises a reed valve.

6. The engine as claimed in claim 1 wherein said fuel means comprises a fuel injector means.

7. The engine as claimed in claim 1 wherein said fuel means comprises a carburettor.

8. The engine as claimed in claim 1 wherein the top of said cylinder is flat and the piston has a hollow in its top defining a combustion chamber for said cylinder.

9. The engine as claimed in claim 1 wherein said combustion chamber is defined by a recess formed in the top of said cylinder which faces a hollow in the top of said piston, said recess and hollow defining a combustion chamber for said cylinder.

10. The engine as claimed in claim 8 or 9 wherein a substantial portion of the top of said piston is substantially flat.

11. The engine as claimed in claim 8 or 9 wherein a substantial portion of the top of said cylinder is substantially flat.

12. The engine as claimed in claim 8 or 9 wherein said combustion chamber is closely adjacent said transfer port and distant from said exhaust port.

13. The engine as claimed in claim 1 wherein said fuel is a diesel fuel.

14. The engine as claimed in claim 1 wherein said fuel is a gasoline oil mixture.

15. The engine as claimed in claim 1 wherein said fuel is a combustible gas.

16. The engine as claimed in claim 14 or 15 and having a spark plug communicating with said cylinder.

17. The engine as claimed in claim 1 wherein a decompression valve communicates with said cylinder.

18. The engine as claimed in claim 17 wherein said decompression valve is located at, or adjacent the top of said cylinder closely adjacent said exhaust port.

19. The engine as claimed in claim 1 wherein said transfer passage has a volume which is an appreciable percentage of the swept volume of said cylinder.

20. The engine as claimed in claim 19 wherein said percentage is in the range of from 30% to 80%.

21. The engine as claimed in claim 1 wherein the dimension of said transfer passage in the radial direction of said cylinder is small.

22. The engine as claimed in claim 21 wherein the dimension of said transfer passage in the circumferential direction of said cylinder is larger than said radial dimension.

23. The engine as claimed in claim 21 or 22 wherein the dimension of said transfer passage in the direction of movement of said piston is an appreciable percentage of the piston stroke.

24. The engine as claimed in claim 1 wherein the volume of said crankcase is minimised.

25. A method of operating a crankcase scavenging two stroke internal combustion engine as claimed in claim 1, said method comprising the steps of:

(a) moving said piston to close said transfer port;

(b) continuing said piston movement to close said exhaust port to thereby compress the contents of said cylinder and to simultaneously depressurise said crankcase;

(c) permitting said air inlet valve to open and introducing substantially fuel free air into said transfer passage towards said transfer port, to blow out of said transfer port and passage any residual fuel/air mixture from a previous cycle;

(d) igniting said compressed contents of said cylinder and reversing the movement of said piston;

(e) continuing the movement of said piston to close said air inlet valve and pressurise said crankcase;

(f) continuing the movement of said piston to open said exhaust port;

(g) continuing the movement of said piston to open said transfer port to thereby permit substantially fuel-free air therein to enter and scavenge said cylinder;

(h) continuing movement of said piston so that some of said substantially fuel free air enters said exhaust port;

(i) continuing the movement of said piston to introduce at least some of the contents of said crankcase into said cylinder via said transfer passage and port to thereby charge said cylinder;

(j) continuing said movement of said piston to close said transfer port and said exhaust port;

(k) continuing the movement of said piston to mix said substantially fuel free air remaining in said cylinder with said charged cylinder contents;

(l) igniting the contents of said cylinder; and (m) repeating the above steps in sequence whilst introducing fluid fuel into said crankcase.

26. The method as claimed in claim 25 and including the further step of controlling the flow of air through said air inlet to control the speed of operation of said engine.

27. The method as claimed in claim 25 or 26 and including the further step of injecting said fuel directly into said crankcase via a fuel injector.

28. The method as claimed in claim 25 or 26 and including the further step of introducing said fuel into said crankcase via a carburettor.

29. The method as claimed in claim 25 or 26 including the further step of opening a decompression valve mounted on said cylinder adjacent said exhaust port during initial cranking of said engine.

30. A method of operating a two stroke internal combustion engine to reduce the oil consumption thereof, said method comprising the steps of:

(i) locating a transfer passage between the engine crankcase and engine transfer port, the volume of said transfer passage being an appreciable fraction of the volume of the swept volume of the cylinder of said engine, (ii) after said transfer port closes, scavenging said transfer port and said transfer passage with substantially fuel free air, (iii) after said transfer port opens, scavenging said combustion chamber with said substantially fuel free air from said transfer passage, (iv) retaining some of said substantially fuel free combustion chamber scavenging air in said combustion chamber to contribute to the combustion gases, and (v) reducing the oil content of the fuel/oil mixture introduced into said crankcase.

31. The method as claimed in claim 30 including the step of:

(vi) minimising the volume of said crankcase.

32. A method of increasing the richness of the gaseous fuel mixture of a two stroke internal combustion engine at starting, said method comprising the steps of:

(i) locating a decompression valve communicating with the cylinder of said engine adjacent the exhaust port thereof, (ii) locating a transfer passage between the cylinder crankcase and engine transfer port, the volume of said transfer passage being an appreciable fraction of the swept volume of said cylinder, (iii) after said transfer port closes, scavenging said transfer port and said transfer passage with substantially fuel free air, (iv) after said transfer port opens, scavenging said cylinder with said substantially fuel-free air from said transfer passage, (v) closing said exhaust port and charging said cylinder via said transfer port with a gaseous fuel mixture from said crankcase, and (vi) maintaining said decompression valve open whilst compressing the contents of said cylinder to expel therefrom some of said substantially fuel free scavenging air otherwise remaining therein, to thereby deplete the air content of said cylinder and increase the richness of the compressed fuel mixture.

* * * * *